US008441349B1

(12) United States Patent
Libby

(10) Patent No.: US 8,441,349 B1
(45) Date of Patent: May 14, 2013

(54) CHANGE DETECTION IN A MONITORED ENVIRONMENT

(75) Inventor: Vibeke Libby, Woodside, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 480 days.

(21) Appl. No.: 12/873,224

(22) Filed: Aug. 31, 2010

Related U.S. Application Data

(60) Provisional application No. 61/240,172, filed on Sep. 4, 2009.

(51) Int. Cl.
*G08B 13/00* (2006.01)

(52) U.S. Cl.
USPC ..... 340/541; 141/94

(58) Field of Classification Search ..... 340/3.5, 340/506, 539.13, 541, 573.1, 552; 141/94
See application file for complete search history.

(56) References Cited

U.S. PATENT DOCUMENTS

| | | | | |
|---|---|---|---|---|
| 6,089,284 | A * | 7/2000 | Kaehler et al. | 141/94 |
| 7,733,220 | B2 * | 6/2010 | Libby | |
| 2007/0018811 | A1 * | 1/2007 | Gollu | 340/539.13 |
| 2007/0210909 | A1 * | 9/2007 | Addy | 340/506 |
| 2008/0129518 | A1 * | 6/2008 | Carlton-Foss | 340/573.1 |
| 2008/0316025 | A1 * | 12/2008 | Cobbinah et al. | 340/552 |
| 2009/0033490 | A1 * | 2/2009 | Anand et al. | 340/541 |
| 2011/0169637 | A1 * | 7/2011 | Siegler et al. | 340/541 |
| 2012/0019351 | A1 * | 1/2012 | Bougaev et al. | 340/3.5 |

FOREIGN PATENT DOCUMENTS

DE 3933684 A1 * 4/1991

OTHER PUBLICATIONS

Wilson, J., et al., "Radio Tomographic Imaging with Wireless Networks," IEEE Transactions on Mobile Computing, May 2010, pp. 621-632, vol. 9, No. 5, IEEE CS, CASS, ComSoc, IES, & SPS.

* cited by examiner

*Primary Examiner* — Daniel Wu
*Assistant Examiner* — Israel Daramola
(74) *Attorney, Agent, or Firm* — McDermott Will & Emery LLP

(57) ABSTRACT

Systems and methods for detecting one or more changes in a monitored environment are provided. A method includes transmitting interrogation signals to sensors distributed in a monitored environment at a substantially constant power. A first set of the interrogation signals is transmitted to a first sensor. The method also includes receiving first response signals from the first sensor in response to the first set of interrogation signals transmitted to the first sensor. The method also includes determining an average parameter of the first response signals from the first sensor. The method also includes comparing the average parameter of the first response signals to an average parameter of baseline signals corresponding to the first sensor. The method also includes determining a statistical significance of the average parameter of the first response signals based on the comparison, and generating a change detection indicator based on the statistical significance.

20 Claims, 11 Drawing Sheets

| # Of Pings | 16 | 17 | 18 | 19 | 37 | 38 | 39 | A | C | B |
|---|---|---|---|---|---|---|---|---|---|---|
| 50 | 30 | 35 | 48 | 34 | 50 | 50 | 50 | 19 | 43 | 44 |
| | 30 | 34 | 48 | 34 | 50 | 50 | 50 | 19 | 43 | 44 |
| | 30 | 35 | 48 | 34 | 50 | 50 | 50 | 19 | 43 | 44 |
| | 30 | 35 | 48 | 34 | 50 | 50 | 50 | 19 | 43 | 44 |
| | 30 | 35 | 48 | 34 | 50 | 50 | 49 | 19 | 43 | 44 |
| | 29 | 34 | 48 | 34 | 50 | 50 | 49 | 19 | 43 | 43 |
| Mean | 29.83333 | 34.66667 | 48 | 34 | 50 | 50 | 49.66667 | 19 | 43 | 43.83333 |
| Var | 0.166667 | 0.266667 | 0 | 0 | 0 | 0 | 0.266667 | 0 | 0 | 0.166667 |
| **Std.dev.** | **0.408248** | **0.516398** | **0** | **0** | **0** | **0** | **0.516398** | **0** | **0** | **0.408248** |

FIG. 4

| Sensors | 16 | 17 | 18 | 37 | 38 | 39 | A | C | B |
|---|---|---|---|---|---|---|---|---|---|
| No Presence | 65 | 74 | 23 | 38 | 28 | 46 | 16 | 1 | 18 |
| 12 ft from perimeter | 66 | 75 | 23 | 37 | 28 | 45 | 14 | 1 | 13 |
| 6 ft from perimeter | 64 | 74 | 22 | 38 | 28 | 46 | 9 | 2 | 16 |
| On perimeter | 66 | 72 | 22 | 42 | 27 | 44 | 14 | 2 | 19 |
| In center of area | 72 | 84 | 22 | 35 | 30 | 49 | 18 | 7 | 6 |

FIG. 6

CHANGE DETECTION IN A MONITORED ENVIRONMENT

CROSS-REFERENCES TO RELATED APPLICATIONS

The present application claims the benefit of U.S. Provisional Patent Application Ser. No. 61/240,172, entitled "INTRUSION DETECTION USING A DISTRIBUTED SENSOR SYSTEM," filed on Sep. 4, 2009, which is hereby incorporated by reference in its entirety for all purposes.

STATEMENT AS TO RIGHTS TO INVENTIONS MADE UNDER FEDERALLY SPONSORED RESEARCH OR DEVELOPMENT

Not Applicable.

FIELD

The present invention generally relates to sensors and, in particular, relates to change detection in a monitored environment.

BACKGROUND

Security systems may be employed to detect changes in a monitored environment due to the intrusion of an entity, such as an unwanted human, animal, or inanimate object. However, many security systems find it difficult to perform proper motion and change detection without being subjected to false alarms. Some of these alarms are due to normal changes to the environment, like moving curtains, changing airflow, automatic light switching, pests, overflying aircraft, distant traffic, normal human activity, or other non-harmful entities entering the monitored environment.

SUMMARY

According to various aspects of the subject technology, a monitoring system is provided that allows for real time evaluation of changes in a monitored environment and compares the changes to established field patterns for the purpose of determining whether the changes are within expected preset limits, and if beyond the preset limits, whether the changes are false alarms or actual alarms. The monitoring system may be used to locate and track unwanted intruders into the monitored environment. In some aspects, the monitored system may be based on high confidence probabilistic algorithms and protocols that sample the environment periodically (e.g., such as every second). In some aspects, the protocols may be implemented in firmware, making the sensor system capable of detecting disturbances in real time.

According to various aspects of the subject technology, a method for detecting one or more changes in a monitored environment is provided. The method comprises transmitting a plurality of interrogation signals to one or more sensors distributed in a monitored environment at a substantially constant power. A first set of the plurality of interrogation signals is transmitted to a first sensor of the one or more sensors. The method also comprises receiving one or more first response signals from the first sensor in response to the first set of the plurality of interrogation signals transmitted to the first sensor. The method also comprises determining an average parameter of the one or more first response signals from the first sensor. The method also comprises comparing the average parameter of the one or more first response signals to an average parameter of a plurality of baseline signals corresponding to the first sensor. The method also comprises determining a statistical significance of the average parameter of the one or more first response signals based on the comparison. The method also comprises generating a change detection indicator based on the statistical significance.

According to various aspects of the subject technology, a system for detecting one or more changes in a monitored environment is provided. The system comprises an interrogator configured to transmit a plurality of interrogation signals to one or more sensors distributed in a monitored environment at a substantially constant power. The interrogator is also configured to transmit a first set of the plurality of interrogation signals to a first sensor of the one or more sensors. The interrogator is also configured to receive one or more first response signals from the first sensor in response to the first set of the plurality of interrogation signals transmitted to the first sensor. The system also comprises a controller coupled to the interrogator. The controller is configured to determine an average parameter of the one or more first response signals from the first sensor. The controller is also configured to compare the average parameter of the one or more first response signals to an average parameter of a plurality of baseline signals corresponding to the first sensor. The controller is also configured to determine a statistical significance of the average parameter of the one or more first response signals based on the comparison. The controller is also configured to generate a change detection indicator based on the statistical significance.

According to various aspects of the subject technology, a machine-readable medium encoded with executable instructions for detecting one or more changes in a monitored environment is provided. The instructions comprise code for transmitting a plurality of interrogation signals to one or more sensors distributed in a monitored environment at a substantially constant power. A first set of the plurality of interrogation signals is transmitted to a first sensor of the one or more sensors. The instructions also comprise code for receiving one or more first response signals from the first sensor in response to the first set of the plurality of interrogation signals transmitted to the first sensor. The instructions also comprise code for determining an average parameter of the one or more first response signals from the first sensor. The instructions also comprise code for comparing the average parameter of the one or more first response signals to an average parameter of a plurality of baseline signals corresponding to the first sensor. The instructions also comprise code for determining a statistical significance of the average parameter of the one or more first response signals based on the comparison. The instructions also comprise code for generating a change detection indicator based on the statistical significance.

According to various aspects of the subject technology, an apparatus for detecting one or more changes in a monitored environment is provided. The apparatus comprises means for transmitting a plurality of interrogation signals to one or more sensors distributed in a monitored environment at a substantially constant power. A first set of the plurality of interrogation signals is transmitted to a first sensor of the one or more sensors. The apparatus also comprises means for receiving one or more first response signals from the first sensor in response to the first set of the plurality of interrogation signals transmitted to the first sensor. The apparatus also comprises means for determining an average parameter of the one or more first response signals from the first sensor. The apparatus also comprises means for comparing the average parameter of the one or more first response signals to an average parameter of a plurality of baseline signals corresponding to the first sensor. The apparatus also comprises means for determining a statistical significance of the average parameter of the one or more first response signals based on the comparison. The apparatus also comprises means for generating a change detection indicator based on the statistical significance.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

FIG. 4 is a chart of exemplary data measured from various sensors in a quiet environment, in accordance with various aspects of the subject technology.

FIG. 6 is a chart of exemplary data measured from sensors of a monitoring system, in accordance with various aspects of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology.

According to various aspects of the subject technology, a monitoring system is provided that can be rapidly deployed and can detect and track multiple intruders simultaneously in a monitored environment. The monitoring system may be an automated wireless alarm system. In some aspects, the monitoring system may be deployed as a battery-supported security system. In some aspects, the monitoring system may detect and locate items left behind in the monitored environment or immobile humans that are hiding in the monitored environment. The monitoring system may monitor a large coverage area (e.g., greater than 325 feet range).

Figure 1:
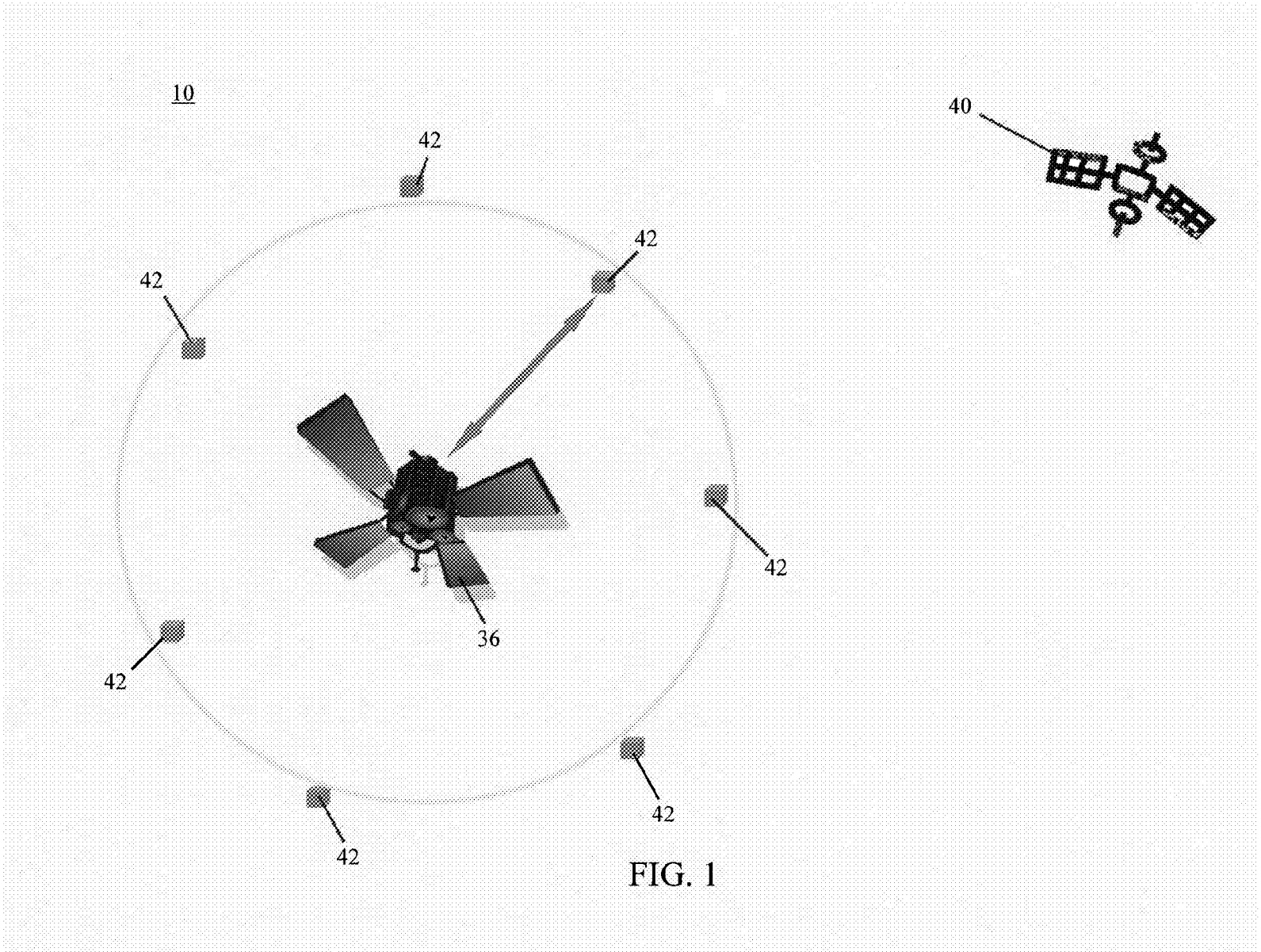
FIG. 1 illustrates an example of a monitoring system deployed in space, in accordance with various aspects of the subject technology.

The monitoring system may be used for a variety of applications, including for example, monitoring an environment for theft, terrorist attacks, accidents, natural disasters, and intrusions. In one example, the monitoring system may be used to locate and track single and multiple intruders in a protected area of 100,000 square feet. Items left behind as well as persons in hiding may be easily detected. In some aspects, changes in the monitored environment can be verified automatically by a cued camera. In one example, the monitoring system may also be used in space. FIG. 1 illustrates an example of monitoring system 10 deployed in space, in accordance with various aspects of the subject technology. In some aspects, monitoring system 10 comprises spacecraft 36, which is in communication with one or more sensors 42. As rogue object 40 approaches spacecraft 36, the stable communication paths between spacecraft 36 and the one or more sensors 42 may be measurably altered, thereby notifying monitoring system 10 of a change in the environment.

Figure 2:
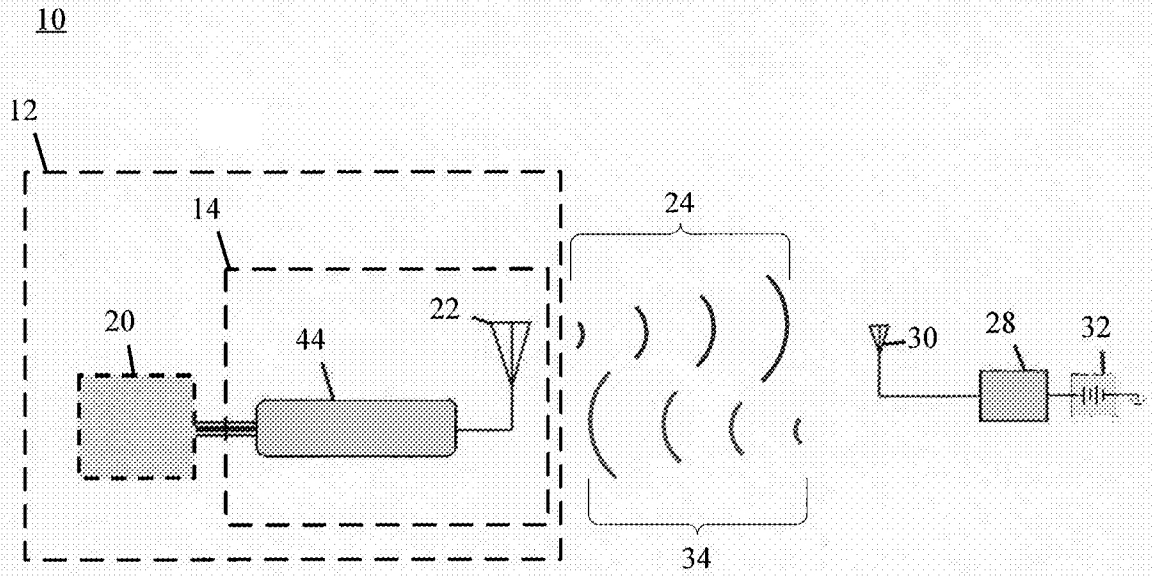
FIG. 2 illustrates an example of a monitoring system, in accordance with various aspects of the subject technology.

FIG. 2 illustrates an example of monitoring system 10, in accordance with various aspects of the subject technology. Monitoring system 10 comprises reader segment 12 communicating with sensor 28 in an environment to be monitored. Although only one sensor 28 is shown in FIG. 2, a plurality of sensors may be distributed in the monitored environment and communicate with reader segment 12. In some aspects, reader segment 12 comprises interrogator 14 coupled to controller 20. Interrogator 14 comprises interface 44 (e.g., a radio frequency interface) and antenna unit 22. Interrogator 14 may interface and communicate with controller 20 via interface 44. In some aspects, communications occurring between controller 20 and interface 44 may be through wired communication or wireless communication. Interrogator may be used to transmit one or more interrogation signals 24 to sensor 28 via antenna unit 22. Sensor 28 may receive the one or more interrogation signals 24 via antenna unit 30. Battery 32 is used to power sensor 28. In response to the one or more interrogation signals 24, sensor 28 transmits one or more response signals 34 to reader segment 12 via antenna unit 30. In some aspects, the one or more response signals 34 may include a message identifying the sensor from which the one or more response signals 34 was transmitted from (e.g., sensor 28). In some aspects, the one or more response signals 34 may include cyclic redundancy checksum information, extended product code information, password/kill code information, and other suitable information.

In some aspects, controller 20 may detect an actual change in the monitored environment (as opposed to normal background events that occur in the monitored environment such as moving curtains, air vents turning on and off, lights going dim, cars passing by, etc.) by comparing the one or more response signals 34 with one or more baseline signals corresponding to sensor 28. In some aspects, the one or more baseline signals are response signals that sensor 28 transmits to reader segment 12 when no changes are occurring in the monitored environment or when a particular normal background event is occurring in the monitored environment but is not considered to be an event that causes an actual change in the monitored environment. The one or more baseline signals may be stored in controller 20 as recognizable normal background events (e.g., background signatures). Thus, if the one or more response signals 34 differ greatly from the one or more baseline signals corresponding to sensor 28, then it is likely that an actual change in the monitored environment has occurred (e.g., an intrusion into the monitored environment). By comparing the one or more response signals 34 with the one or more baseline signals corresponding to sensor 28, false alarms may be minimized. In some aspects, reader segment 12 may comprise or be coupled to a camera. The camera may be used to capture changes occurring in the monitored environment and provide verification of whether the change is an actual change or a false alarm.

In some aspects, antenna unit 30 and antenna unit 22 may be high-performance area antennas or dual-directional panel antennas. In some aspects, antenna unit 22 may comprise circular polarized receive and transmit units that can be co-located or separated, and may connect to interface 44.

Although sensor 28 is shown as being powered by battery 32, sensor 28 may operate without battery 32 and may be a passive sensor that is powered from the one or more interrogation signals 24. Passive sensors may be useful for short range operations, such as for ranges of less than 100 feet. In some aspects, sensor 28 may be an active sensor and transmit one or more response signals 34 to reader segment 12 even when the one or more interrogation signals 24 have not been transmitted to sensor 28. Active sensors may be useful for long range operations, such as for ranges of greater than 100 meters. In some aspects, sensor 28 may be a battery-assisted passive sensor. The one or more interrogation signals 24 may be used to "wake up" sensor 28, after which sensor 28 may rely on battery 32 for transmitting the one or more response signals 34 back to reader segment 12. Battery-assisted passive sensors may also be useful for long range operations. An additional advantage with using battery-assisted passive sensors is that battery power may be conserved when these sensors are not in use, thereby extending the long term use of monitoring system 10. Although antenna unit 30 and battery 32 are shown as external to sensor 28, antenna unit 30 and/or battery 32 may also be internal to sensor 28.

A plurality of sensors, such as sensor 28, may be distributed in the monitored environment. The sensors may be configured such that none of the sensors communicates with another of the sensors. In other words, centralized monitoring may be utilized, with reader segment 12 communicating with each of the sensors. Because the sensors do not communicate with one another, power can be appropriately managed by reader segment 12 and may also be conserved for each of the sensors. For example, monitoring system 10 may be optimized for power conservation through its architecture, allowing for the sensors to operate for years before the respective batteries for the sensors are depleted. By having each sensor communicate only through reader segment 12, and not with other sensors, each sensor may receive a power burst from the one or more interrogation signals 24. In some aspects, when a sensor reaches a low-battery condition, a low-battery indicator message may be sent to reader segment 12.

According to various aspects of the subject technology, the sensors may be tags such as radio frequency identification (RFID) tags, paper thin dual dipole read-only tags, or other suitable tags. In some aspects, commercial off the shelf (COTS) sensors and/or radios may be employed, thereby allowing monitoring system 10 to be implemented at relatively low costs. The sensors, because of their small size, may be portable and easy to conceal within the monitored environment. The sensors may be equipped with programmable sensitivity settings or adjustable alarm levels.

According to certain aspects, the sensors may frequency hop through random sets of frequencies, thereby making monitoring system 10 more difficult to spoof. Thus, aspects of the subject technology provide a cost effective solution for a spoofing proof monitoring system. Aspects of the subject technology also provide a ground-based security system with a low false alarm rate.

Figure 3:
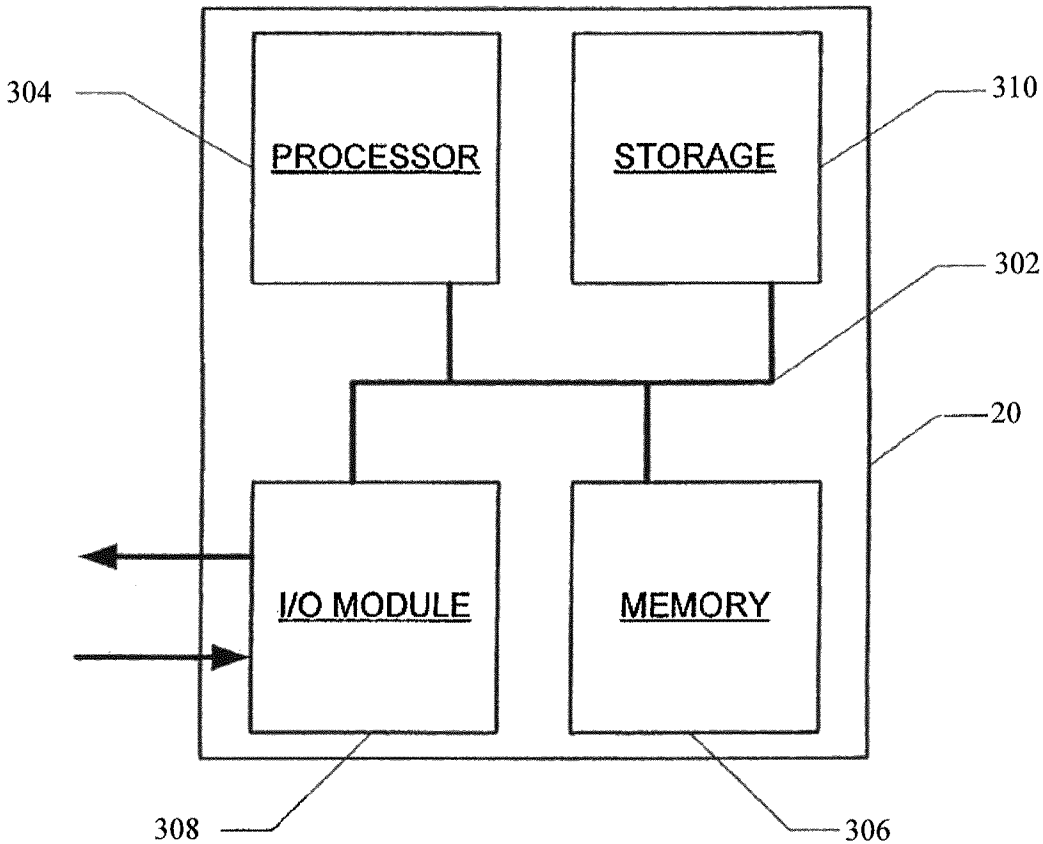
FIG. 3 is a block diagram illustrating components of a controller, in accordance with various aspects of the subject technology.

FIG. 3 is a block diagram illustrating components of controller 20, in accordance with various aspects of the subject technology. Controller 20 may be a computer, a processor, and/or other suitable processing units for operating monitoring system 10. In some aspects, controller 20 comprises processor module 304, storage module 310, input/output (I/O) module 308, memory module 306, and bus 302. Bus 302 may be any suitable communication mechanism for communicating information. Processor module 304, storage module 310, I/O module 308, and memory module 306 are coupled with bus 302 for communicating information between any of the modules of controller 20 and/or information between any module of controller 20 and a device external to controller 20. For example, information communicated between any of the modules of controller 20 may include instructions and/or data. In some aspects, bus 302 may be a universal serial bus. In some aspects, bus 302 may provide Ethernet connectivity.

In some aspects, processor module 304 may comprise one or more processors, where each processor may perform different functions or execute different instructions and/or processes. For example, one or more processors may execute instructions for operating interrogator 14, and one or more processors may execute instructions for input/output functions.

Memory module 306 may be random access memory ("RAM") or other dynamic storage devices for storing information and instructions to be executed by processor module 304. Memory module 306 may also be used for storing temporary variables or other intermediate information during execution of instructions by processor 304. In some aspects, memory module 306 may comprise battery-powered static RAM, which stores information without requiring power to maintain the stored information. Storage module 310 may be a magnetic disk or optical disk and may also store information and instructions. In some aspects, storage module 310 may comprise hard disk storage or electronic memory storage (e.g., flash memory). In some aspects, memory module 306 and storage module 310 are both a machine-readable medium.

Controller 20 is coupled via I/O module 308 to a user interface for providing information to and receiving information from an operator of monitoring system 10. For example, the user interface may be a cathode ray tube ("CRT") or LCD monitor for displaying information to an operator. The user interface may also include, for example, a keyboard or a mouse coupled to controller 20 via I/O module 308 for communicating information and command selections to processor module 304.

According to various aspects of the subject disclosure, methods described herein may be executed by controller 20. Specifically, processor module 304 executes one or more sequences of instructions contained in memory module 306 and/or storage module 310. In one example, instructions may be read into memory module 306 from another machine-readable medium, such as storage module 310. In another example, instructions may be read directly into memory module 306 from I/O module 308, for example from an operator of monitoring system 10 via the user interface. Execution of the sequences of instructions contained in memory module 306 and/or storage module 310 causes processor module 304 to perform methods to detect changes in the monitored environment. For example, a computational algorithm for detecting changes in the monitored environment may be stored in memory module 306 and/or storage module 310 as one or more sequences of instructions. Information such as the rotational speed and/or deceleration rate of the motor may be communicated from processor module 304 to memory module 306 and/or storage module 310 via bus 302 for storage. In some aspects, the information may be communicated from processor module 304, memory module 306, and/or storage module 310 to I/O module 308 via bus 302. The information may then be communicated from I/O module 308 to an operator of monitoring system 10 via the user interface.

One or more processors in a multi-processing arrangement may also be employed to execute the sequences of instructions contained in memory module 306 and/or storage module 310. In some aspects, hard-wired circuitry may be used in place of or in combination with software instructions to implement various aspects of the subject disclosure. Thus, aspects of the subject disclosure are not limited to any specific combination of hardware circuitry and software.

The term "machine-readable medium," or "computer-readable medium," as used herein, refers to any medium that participates in providing instructions to processor module 304 for execution. Such a medium may take many forms, including, but not limited to, non-volatile media and volatile media. Non-volatile media include, for example, optical or magnetic disks, such as storage module 310. Volatile media include dynamic memory, such as memory module 306. Common forms of machine-readable media or computer-readable media include, for example, floppy disk, a flexible disk, hard disk, magnetic tape, any other magnetic medium, a CD-ROM, DVD, any other optical medium, punch cards, paper tape, any other physical mediums with patterns of holes, a RAM, a PROM, an EPROM, a FLASH EPROM, any other memory chip or cartridge, or any other medium from which a processor can read.

According to various aspects of the subject technology, baseline signals corresponding to the sensors of monitoring system 10 may be stored in a signature database (e.g., stored in memory module 306 and/or storage module 310). In particular, parameters of these baseline signals may be stored in the signature database. These parameters may then be compared to the parameters of any response signals that reader segment 12 receives from the sensors distributed in the monitored environment. Depending on the difference between the parameters of the response signals and the parameters of the baseline signals, controller 20 may determine whether an actual change has occurred in the monitored environment. For example, the parameters of the baseline signals may collectively represent the characteristics of an undisturbed monitored environment. When an object enters the monitored environment, the parameters of the response signals received by reader segment 12 become different compared to the parameters of the baseline signals. Based on this difference, controller 20 may determine whether an actual change has occurred in the monitored environment.

The parameters of the baseline signals and response signals may represent, for example, the strength, power, noise level, count, frequency band, frequency, geometry, range, or other suitable parameters of these signals. Combinations of any of these parameters may be used for detecting changes in the monitored environment. For example, power, frequency, and strength may be used in combination to determine whether changes have occurred in the monitored environment. In some aspects, it may be advantageous to measure the strength of the response signals to compare against the strength of the baseline signals. For example, sensors may transmit response signals to reader segment 12, and reader segment 12 may monitor a return signal strength indicator (RSSI) value for the response signal received from each sensor. The RSSI values may then be compared to RSSI values of the baseline signals of the corresponding sensors for determining whether changes have occurred in the monitored environment. Measuring and comparing the strengths of the response signals to the strengths of the baseline signals may be non-complex, thereby allowing for much faster response times in determining whether changes have occurred in the monitored environment. In some aspects, the RSSI values may be displayed to an operator of monitoring system 10. In some aspects, the RSSI values are measured in volts.

According to various aspects of the subject technology, monitoring system 10 may be calibrated to determine the parameters of the baseline signals corresponding to the sensors of monitoring system 10. These parameters of the baseline signals may be stored as parameter maps in the signature database, and may be viewed as multi-dimensional fingerprints of the monitored environment. If n is a discrete parameter measured in some unit U and is sampled a fixed number of times, the mean, variance, and standard deviation of n can be calculated. For example, in a quiet environment, the parameters of the baseline signals may be stable with a standard deviation of:

$$\sigma_o<0.5U \tag{1}$$

The variation in such a quiet environment may be mainly due to electronic noise. The statistical values of n may be stored in the signature database. During operation, the stability of the parameters may be monitored for changes within allowable ranges. These ranges can be set automatically or may be user defined. FIG. 4 is a chart of exemplary data measured from various sensors in a quiet environment, in accordance with various aspects of the subject technology. In this example, sensors 16, 17, 18, 19, 37, 38, 39, A, B, and C were distributed in a quiet environment and were each sent 50 interrogation signals (e.g., in this example as pings from reader segment 12). The count or number of response signals from each sensor (e.g., the parameter of these signals) responding to the 50 interrogation signals is also listed. This communication between reader segment 12 and the sensors was repeated six times. The chart also lists the mean, variance, and standard deviation for each sensor. The variation was about 0 to 0.5% in the quiet environment. In contrast, a noisy environment may exhibit a 1-2% variation, for example.

In an outdoor operational environment, for example, where communication channels between sensors and reader segment 12 may be affected by air traffic, distant motor vehicles, and wireless communications, a larger variation of n may typically be observed:

$$\sigma_{field}<2.5U \tag{2}$$

For changing environments, several parameter maps may be stored in the signature database to capture natural variations in the monitored environment, such as variations from day versus night environments, air traffic, or distant human activity.

Figure 5:
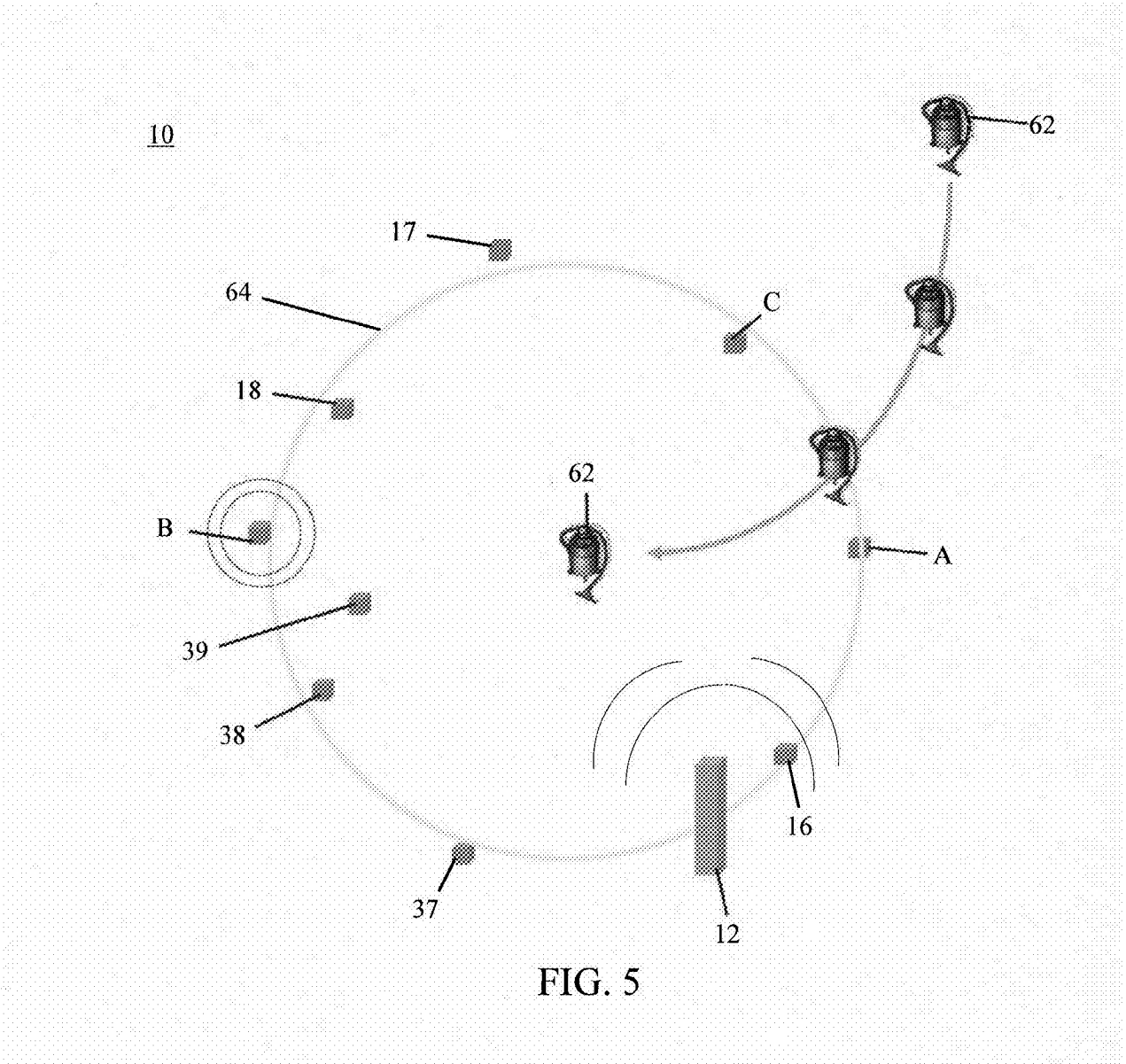
FIG. 5 illustrates an example of an object entering a monitored environment, in accordance with various aspects of the subject technology.

FIG. 5 illustrates an example of object 62 entering monitored environment 64, in accordance with various aspects of the subject technology. As shown in this figure, monitoring system 10 comprises reader segment 12 communicating with sensors 16, 17, 18, 37, 38, 39, A, B, and C. As object 62 approaches closer to monitored environment 64, the communication between reader segment 12 and the sensors may be affected. FIG. 6 is a chart of exemplary data measured from the sensors of monitoring system 10 shown in FIG. 5. In this example, the diameter of monitored environment 64 is 22 feet. The chart lists the count or number of response signals from each sensor (e.g., the parameter of these signals) when object 62 is located in various positions relative to monitored environment 64. The count or number of response signals from each sensor changes depending on the location of object 62 relative to monitored environment 64. Based on the variation of the count or number of response signals from average, controller 20 may determine whether or not an actual change is occurring in monitored environment 64.

Figure 7:
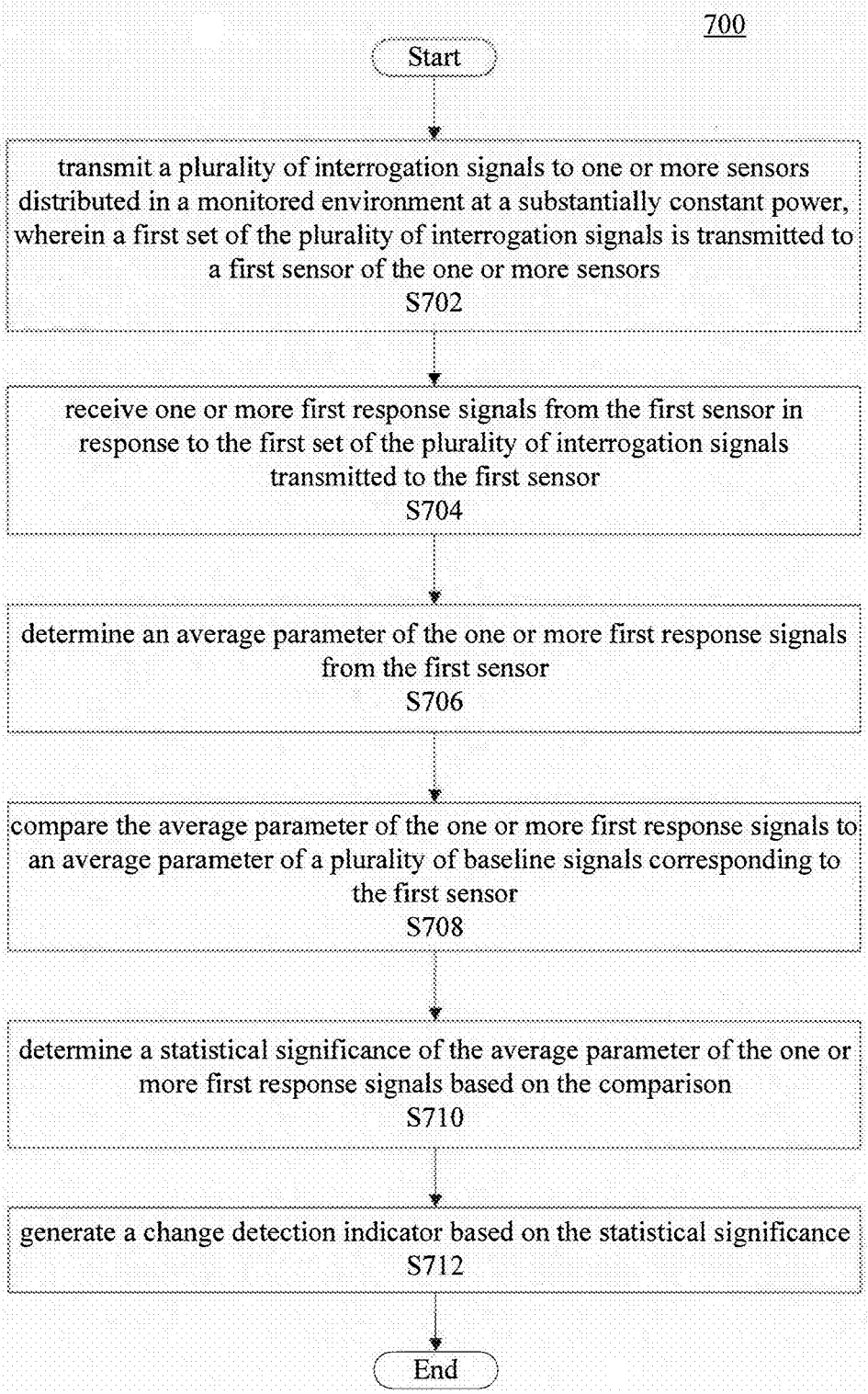
FIG. 7 illustrates an example of a method for detecting one or more changes in a monitored environment, in accordance with various aspects of the subject technology.

FIG. 7 illustrates an example of method 700 for detecting one or more changes in a monitored environment. Method 700 may be implemented by monitoring system 10. One or more sequences of instructions used to perform method 700 may be stored in memory module 306 and/or storage module 310. Processor module 304 may continually execute these sequences of instructions to perform method 700.

In an initialization process at the "Start" of method 700, monitoring system 10 may be calibrated as described above by collecting the parameters of the baseline signals of the sensors of monitoring system 10 and storing the parameters into the signature database. Method 700 comprises transmitting a plurality of interrogation signals to one or more sensors distributed in a monitored environment at a substantially constant power (S702). A first set of the plurality of interrogation signals is transmitted to a first sensor of the one or more sensors. The first set of the plurality of interrogation signals may comprise one or more interrogation signals. For example, referring to FIG. 2, reader segment 12 may transmit the one or more interrogation signals 24 to sensor 28 and/or other sensors of monitoring system 10 at a substantially constant power. In some aspects, transmitting a plurality of interrogation signals at a substantially constant power provides advantages over conventional systems that transmit interrogation signals at a plurality of power levels. In conventional systems, an interrogation signal is transmitted at a certain power level to elicit a response signal, and subsequent interrogation signals are transmitted at increasingly lower power levels until a response signal is not received, thereby notifying operators of the conventional systems whether failure has occurred. These failures are used to determine whether a change in a monitored environment has occurred. In contrast, aspects of the subject technology use transmission of a plurality of interrogation signals at a substantially constant power to reduce the complexity of implementing monitoring system 10. Without needing to determine whether a failure has occurred like conventional systems, controller 20 of monitoring system 10 may compare the parameters of response signals (e.g., signal strength) with the parameters of the baseline signals to determine whether a change has occurred. This results in a faster implementation of monitoring system 10.

In some aspects, the plurality of interrogation signals may be transmitted employing spread spectrum frequency hopping. To meet federal communications commission (FCC) requirements, the plurality of interrogation signals may be transmitted at frequency hops between a certain number of frequencies (e.g., 50 frequencies), before starting over and going through the same random set of frequencies again, but in another order. In some aspects, the operating frequencies for the communication of monitoring system 10 is from 902 megahertz (MHz) to 928 MHz. However, the operating frequencies of the communication of monitoring system 10 is not limited to this range, but may include other suitable operating frequency ranges. Frequency hop tables may be stored, for example, in memory module 306 and/or storage module 310. The frequency hopping may be controlled by controller 20. By accessing the frequency hop tables, aspects of the subject technology not only know which frequency is being used for a particular sensor, but also know the parameter of the response signal from that particular sensor (e.g., power, signal strength, etc.). During undisturbed circumstances, the parameter of the response signal may remain constant. As changes occur, the parameter of the response signal from the particular sensor may change, thereby indicating that an actual change may have occurred in the monitored environment.

According to various aspects of the subject technology, method 700 also comprises receiving one or more first response signals from the first sensor in response to the first set of the plurality of interrogation signals transmitted to the first sensor (S704). Receiving a response signal does not necessarily mean receiving an actual response signal. In some aspects, receiving a response signal may mean that no response signal was received from a particular sensor within a particular time after a particular interrogation signal was transmitted to that particular sensor (e.g., the response signal is expected to be received from the particular sensor that was transmitted the particular interrogation signal but was not received within the particular time). In other words, the response signal received in this case may be effectively "zero" after expiration of the particular time that a response signal is expected to be received.

According to various aspects of the subject technology, reader segment 12 may transmit the first set of interrogation signals to the first sensor at a first set of one or more frequencies. Reader segment 12 may also transmit a second set of the interrogation signals to a second sensor at a second set of one or more frequencies, and receive one or more second response signals from the second sensor. In some aspects, the first set of one or more frequencies is different from the second set of one or more frequencies. In this way, collision between the interrogation signals may be minimized by sending the interrogation signals on different frequencies to different sensors.

In some aspects, sensors may be configured to respond to different sets of frequencies to minimize collision of their respective response signals. For example, the first sensor may transmit one or more first response signals to reader segment 12 if the first set of interrogation signals falls within the range of the first set of one or more frequencies. If the first set of interrogation signals are beyond the range of the first set of one or more frequencies, then the first sensor may withhold transmission of the one or more first response signals to reader segment 12. In some aspects, reader segment 12 may transmit the first set of interrogation signals and the second set of interrogation signals in a sequence such that collision between the one or more first response signals and the one or more second response signals is avoided.

According to various aspects of the subject technology, method 700 also comprises determining an average parameter of the one or more first response signals from the first sensor (S706). The average parameters of the response signals from other sensors may also be determined. In general, $X_i^k$ may be used to represent the average $i^{th}$ parameter of one or more response signals corresponding to a $k^{th}$ sensor. For example, $X_1^1$ may represent the average signal strength of the one or more first response signals from the first sensor, while $X_2^1$ may represent the average power of the one or more first response signals from the first sensor. In some aspects, a parameter for when no response signal was received from a particular sensor within a particular time (after a particular interrogation signal was transmitted to that particular sensor) may be given a value of zero.

According to various aspects of the subject technology, method 700 also comprises comparing the average parameter of the one or more first response signals to an average parameter of a plurality of baseline signals corresponding to the first sensor (S708). The average parameter of the response signals from the other sensors may also be compared to the average parameters of the baseline signals corresponding to the other sensors. Let $\mu_i^k$ and $\sigma_i^k$ be the mean and standard deviation, respectively, of the $i^{th}$ parameter of a baseline signal corresponding to the $k^{th}$ sensor. Thus, according to certain aspects, $X_i^k$ may be compared to $\mu_i^k$ in order to determine if a change has occurred in the monitored environment. In particular, the statistical significance based on this comparison may be used to determine whether a change has occurred in the monitored environment.

According to various aspects of the subject technology, method 700 comprises determining a statistical significance of the average parameter of the one or more first response signals based on the comparison (S710). In general the statistical significance of j samples of an average parameter of the response signals for each sensor may be expressed as:

$$S_i^k = \frac{\frac{1}{j}\sum_j X_{ij}^k - \mu_i^k}{\sigma_i^k} \tag{3}$$

In some aspects, the computed statistical significance is the difference between the average parameter of one or more response signals from a particular sensor and the average parameter of one or more baseline signals corresponding to the particular sensor, divided by the standard deviation from the average parameter of the one or more baseline signals corresponding to the particular sensor. In some aspects, the greater the statistical significance, the likelier that an actual change in the monitored environment has occurred. Correspondingly, the lesser the statistical significance, the likelier that an actual change in the monitored environment has not occurred.

Thus, according to equation (3), if $\sigma_i^k$ is small (e.g., the monitored environment is very quiet while collecting baseline signals), then even small changes to the monitored environment may result in higher significance, informing an operator of monitoring system 10 that an actual change has occurred. For example, a drop of a pin may be detected in a quiet environment. In contrast, if $\sigma_i^k$ is large (e.g., the monitored environment is noisy while collecting baseline signals), then small changes to the monitored environment may result in low statistical significance. For example, a drop of a pin may not be detected as an actual change in a noisy environment, thereby reducing the possibility of a false alarm. Equation (3) also shows that greater statistical confidence may be achieved with a larger operational dataset.

Figure 8:
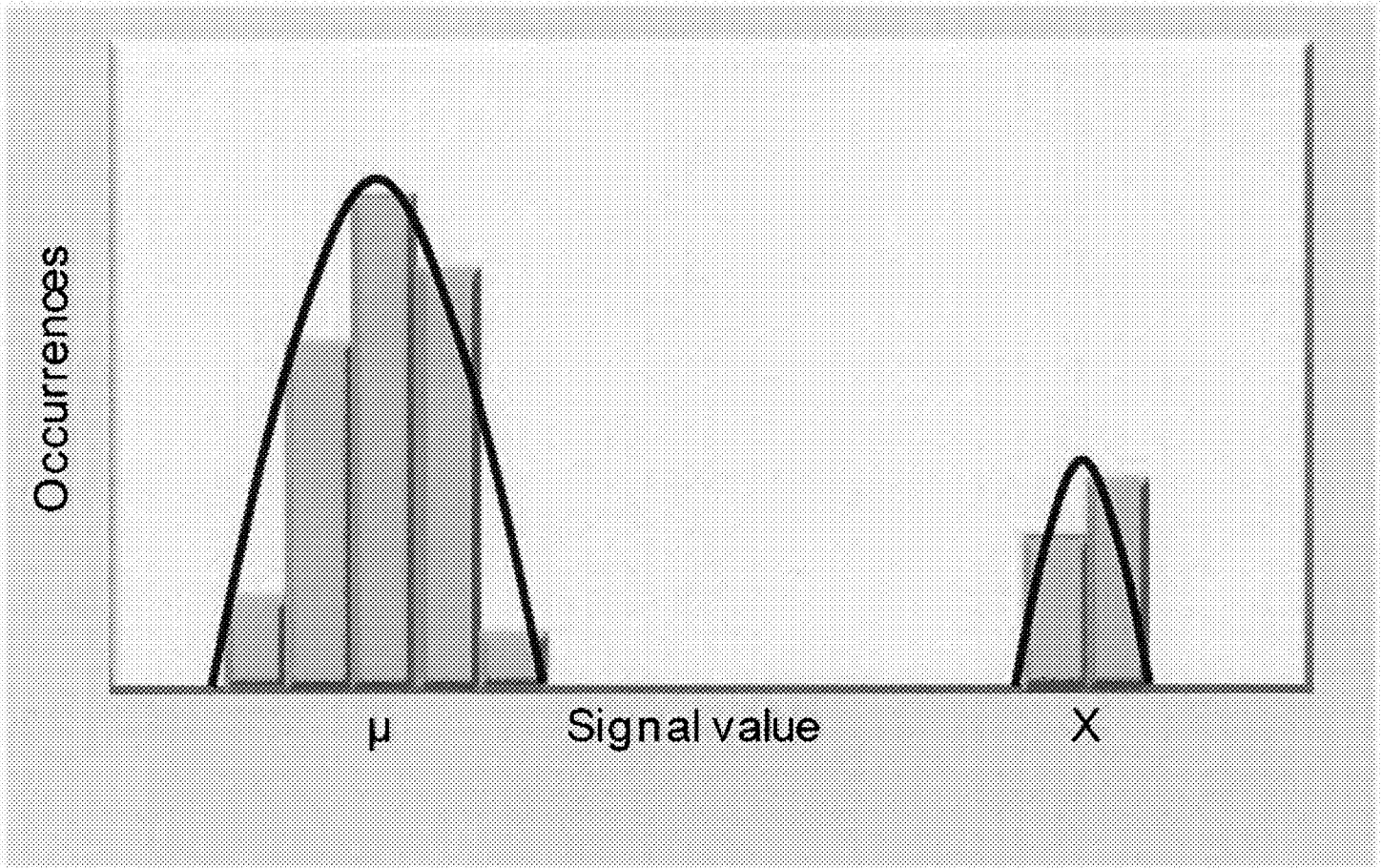
FIG. 8 is a graphical representation of the statistical significance of a response signal that may represent an actual change to a monitored environment, in accordance with various aspects of the subject technology.

FIG. 8 is a graphical representation of equation 3, in accordance with various aspects of the subject technology. In particular, on the horizontal axis, the signal value (e.g., the parameter of a particular signal) is represented. On the vertical axis, the number of occurrences of the signal having a particular signal value is represented. As shown, the greater the separation between X and μ on the horizontal axis, the greater the statistical significance according to equation (3). In this example, a response signal having the parameter X may indicate an actual change. In contrast, the closer that X is to μ on the horizontal axis, the lower the statistical significance according to equation (3).

Since an actual change in a monitored environment (e.g., an intrusion) can cause both an increase and a decrease in a parameter of the response signal, the statistical significance $S_i^k$ can assume both negative and positive values. From experimental data, samples taken milliseconds apart display a close-to-normal distribution in communication values in a disturbance-free environment. With this assumption, the probability that the j samples represent a false alarm in the parameter, for the case when $S_i^k<0$ can be calculated as:

$$P_{false\text{-}alarm} = \frac{1}{\sqrt{2\pi}}\int_{-\infty}^{S_i^k} e^{\frac{-u^2}{2}}\,du \tag{4}$$

In some aspects, equation (4) does not need to be computed for every sample but can be determined by a look-up table (e.g., stored in memory module 306 and/or storage module 310).

Figure 9A:
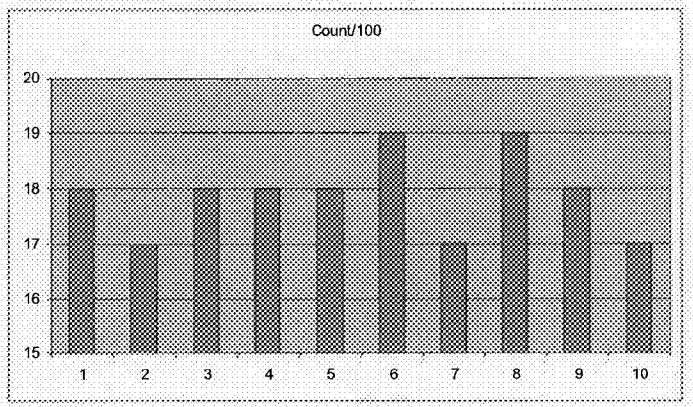
FIG. 9A is a graph showing various values of a parameter of a plurality of baseline signals corresponding to a particular sensor, in accordance with various aspects of the subject technology.
Figure 9B:
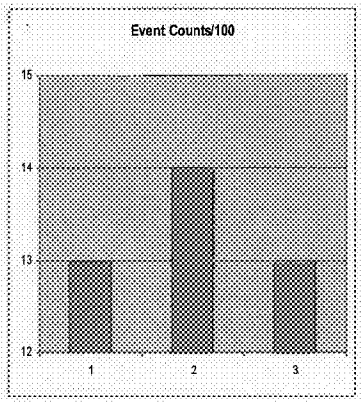
FIG. 9B is a graph showing various values of a parameter of a plurality of response signals corresponding to the particular sensor of FIG. 9A, in accordance with various aspects of the subject technology.

FIGS. 9A and 9B illustrate an example of applying equation (3) and equation (4), in accordance with various aspects of the subject technology. FIG. 9A is a graph showing various values of a parameter of a plurality of baseline signals corresponding to a particular sensor. Each baseline signal is represented on the horizontal axis. The value of the parameter of each baseline signal is represented on the vertical axis. The value of the parameter may be any suitable unit depending on what the parameter is (e.g., signal strength, power, count, etc.). In this example, the value of the parameter may be unit-less. For this particular set of data, the mean, variance, and standard deviation may be determined as follows:

$$\text{Mean}=\mu=(3*17+5*18+2*19)/10=17.9 \tag{5}$$

$$\text{Variance}=\sigma^2=[3*(0.9)2+5*(0.1)2+2*(1.1)2]/9=0.54 \tag{6}$$

$$\text{Standard Deviation}=\sigma=0.7378 \tag{7}$$

FIG. 9B is a graph showing various values of a parameter of a plurality of response signals corresponding to the particular sensor of FIG. 9A. Each response signal is represented on the horizontal axis. The value of the parameter of each response signal is represented on the vertical axis. The value of the parameter may be any suitable unit depending on what the parameter is (e.g., signal strength, power, count, etc.). In this example, the parameter of the response signals is the same as the parameter of the baseline signals of FIG. 9A. For this set of data, the mean may be determined as follows:

$$\text{Mean}=X=(13+13+14)/13=13.33 \tag{8}$$

Thus, according to equation 3, the statistical significance may be determined as follows:

$$S = \frac{X-\mu}{\sigma} = (13.33-17.9)/07378 = -6.2 \tag{9}$$

The probability that this measurement is a false alarm may be determined as follows:

$$P_{false\text{-}alarm} = \frac{1}{\sqrt{2\pi}} \int_{-\infty}^{S} e^{\frac{-u^2}{2}} du \sim 3 \times 10^{-10} \tag{10}$$

In other words, it is highly unlikely that the particular event that resulted in the response signals having their respective parameter values of FIG. 9B is a false alarm. In this regard, it may be determined with confidence that the particular event is an actual change in the monitored environment.

Returning to FIG. 7, method 700 also comprises generating a change detection indicator based on the statistical significance (S712). For example, if the statistical significance is greater than a predetermined threshold, controller 20 may generate the change detection indicator to notify an operator of monitoring system 10 (e.g., via a user interface coupled to I/O module 308) that an actual change in the monitored environment has occurred. The predetermined threshold may be determined and set by the operator to create alarm conditions. In some aspects, the alarm conditions may be individually set for each sensor of the monitoring system 10. For example, a sensor placed in a locked remote storage facility may have a different alarm condition than a sensor guarding a room in a populated building. In some aspects, this capability is possible because each sensor has only one unique communication link to reader segment 12 unlike distributed sensor networks where several links are interacting simultaneously.

In some aspects, the alarm conditions of a sensor at a first instance may be grouped with the alarm conditions of the same sensor at later instances to determine whether an actual change has occurred. For example, a change detection indicator may be generated if the statistical significance of a parameter of a first response signal, a parameter of a second response signal, and a parameter of a third response signal all from the same sensor exceed a certain magnitude. Thus, if the probability of a false alarm for one of these signals is on the order of $10^{-3}$ when one of the statistical significance value exceeds the certain magnitude, then three simultaneous statistical significance values that exceed the certain magnitude may be on the order of $10^{-9}$, which indicates that it is highly unlikely that the particular event is a false alarm, but rather is an actual change.

In some aspects, the change detection indicator may be based on the statistical significance values of the average parameter of response signals from different sensors. For example, an actual change condition may require that at least 15% of all sensors distributed in a section of a monitored environment simultaneously have statistical significance values greater than a certain magnitude.

Figure 10:
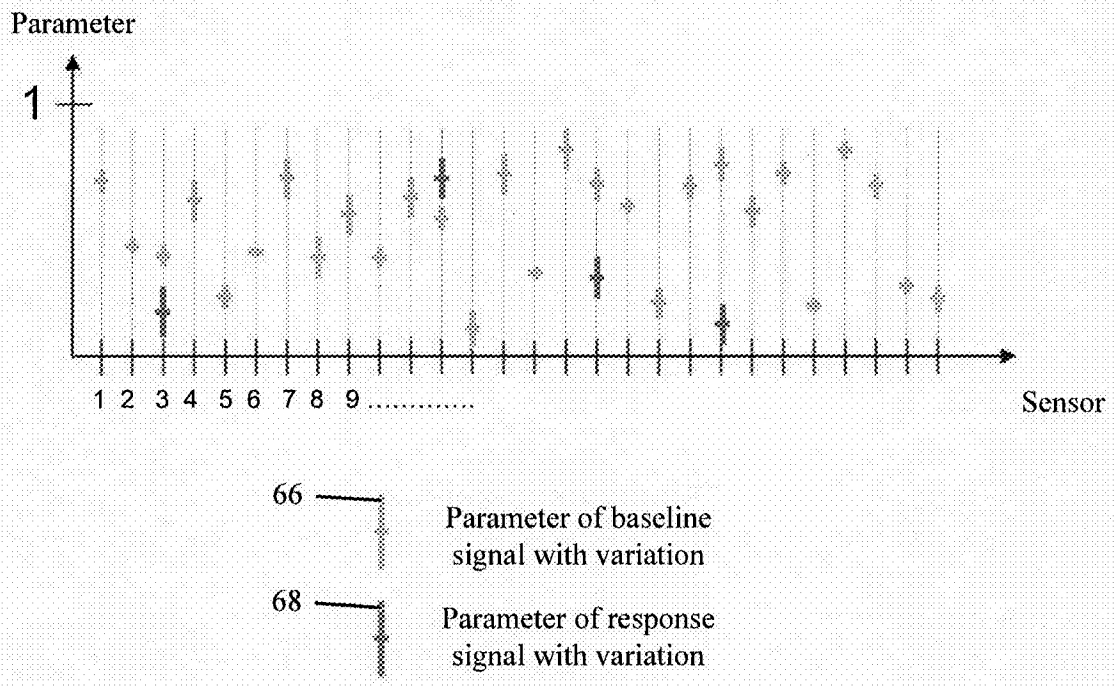
FIG. 10 illustrates an example of a plot of average parameters of baseline signals and response signals of various sensors, in accordance with various aspects of the subject technology.

FIG. 10 illustrates an example of a plot of average parameters of baseline signals and response signals of various sensors, in accordance with various aspects of the subject technology. The sensors are represented on the horizontal axis, while the values of the parameters of the baseline signals and the response signals are represented on the vertical axis, normalized to 1. Each symbol 66 represents a distribution of the parameter of a baseline signal, while each symbol 68 represents a distribution of the parameter of a corresponding response signal. The larger the distance between symbol 66 and symbol 68, the likelier that the particular event occurring in the monitored environment is an actual change. In some aspects, if multiple sensors exhibit a large distance between its respective symbols 66 and 68, then it is likely than an actual change in the monitored environment is occurring.

Let m be the number of sensors exceeding their alarm conditions in a monitoring system. In some aspects, the parameter-maps for these m sensors can be collectively fused to determine the location of a particular actual change in the monitored environment (e.g., location of an intruder). Because of the large statistical significances that actual changes cause, many relatively non-complex algorithms can be applied. The choice of algorithm may depend on the density of sensors as well as the desired fidelity of the solution. If the approximate coordinates of the actual change are used as a handover to a camera coupled to reader segment 12, there may be no need to determine coordinates of the actual change more precisely than the camera can point. In some aspects, the actual change may need to be within the field of view of the camera for a particular duration (e.g., 1-2 seconds) after the handover. As parameters of response signals from the sensors are collected, these parameters are compared to the parameters of the baseline signals.

In an exemplary operation, monitoring system 10 may be implemented as a security system. A human intruder may affect one or more communication channels in the vicinity of an intrusion point into a monitored environment. An object or a human does not need to be in the direct communication path between each sensor distributed in the monitored environment and reader segment 12 to affect the communication of a particular sensor. In some aspects, the disturbance from the intruder is likely to affect several sensors in the monitored environment to various degrees dependent on the relative position of the intruder and the sensors. This variation may be used to find the location of the intrusion and to determine if more than one intrusion is occurring. In field collected measurements, it was approximately determined that $$X_{human} - \mu_0 \geqq 4.5\sigma_0 \tag{11}$$

In a field demonstration, monitoring system 10 was integrated seamlessly with a field camera with slew and zoom capability. The demonstration showed that data can be analyzed in real time, and alarms issued only about 1-2 seconds after an intrusion was initiated. As verified by the demonstration, monitoring system 10 is capable of identifying single intruder or multiple intruder breaches, while tracking the intruders with the camera. Monitoring system 10 is also capable of identifying the location of objects left behind in the monitored environment, in addition to the location of persons hiding in the monitored environment.

In the demonstration, the location of an object left behind in the monitored environment was found to an accuracy of about 3-4 inches, and the position of a moving intruder was located within less than 1 foot when sensor spacing was about 6-10 feet. The range of the sensors used in this demonstration was about 150 feet. However, sensors with greater ranges may also be used. For example, increasing the range of these sensors to 325 feet may allow for a much lower sensor density while still maintaining overall performance and detection capability.

As illustrated by this demonstration, an intruder may have to spend less than one second inside a 325 foot diameter monitored environment to be undetected. Thus, monitoring system 10 provides a secure and reliable way to detect intrusions in a monitored environment. Combined with volumetric properties, monitoring system 10 can detect and locate items that are stationary, or thrown or dropped into the monitored environment. In contrast, such activity may go undetected in fence-based systems and could be too rapid for even a camera to detect. In some aspects, monitoring system 10 may account for seasonal changes (e.g., changes lasting 9-12 months), which may be useful to determine the behavior of a monitored environment under various conditions including extreme temperatures, wind, rain, snow, sand, dust, tumble weeds, critters, larger animals, and environmental hazards.

Figure 11:
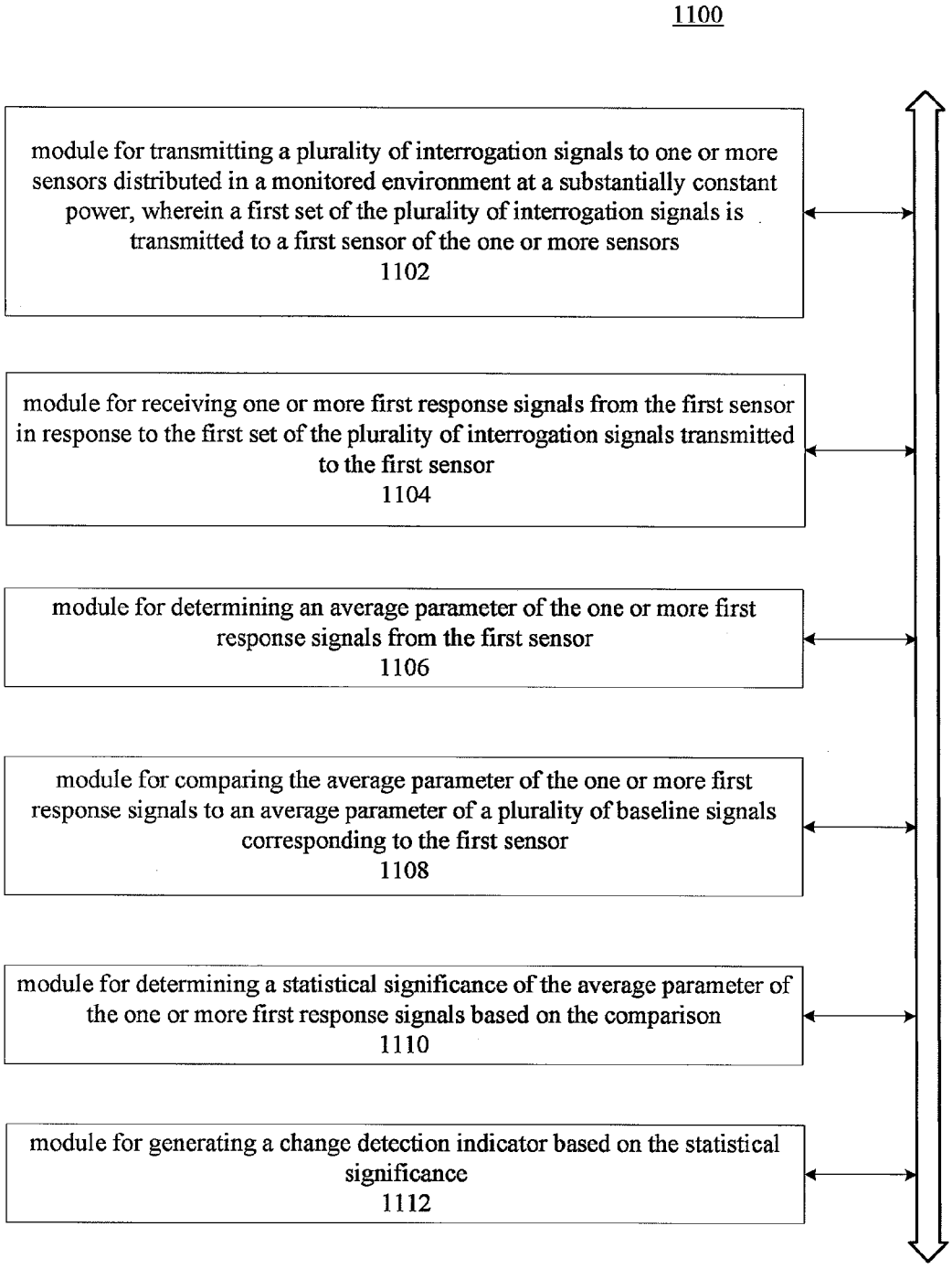
FIG. 11 illustrates an example of an apparatus for detecting one or more changes in a monitored environment, in accordance with various aspects of the subject technology.

FIG. 11 illustrates an example of apparatus 1100 for detecting one or more changes in a monitored environment. Apparatus 1100 comprises module for transmitting one or more interrogation signals to one or more sensors distributed in a monitored environment at a substantially constant power, wherein a first set of the one or more interrogation signals is transmitted to a first sensor of the one or more sensors (1102). Apparatus 1100 also comprises module for receiving one or more first response signals from the first sensor in response to the first set of the one or more interrogation signals transmitted to the first sensor (1104). Apparatus 1100 also comprises module for determining an average parameter of the one or more first response signals from the first sensor (1106). Apparatus 1100 also comprises module for comparing the average parameter of the one or more first response signals to an average parameter of a plurality of baseline signals corresponding to the first sensor (1108). Apparatus 1100 also comprises module for determining a statistical significance of the average parameter of the one or more first response signals based on the comparison (1110). Apparatus 1100 also comprises module for generating a change detection indicator based on the statistical significance (1112).

According to various aspects of the subject technology, a monitoring system is provided that is able to achieve a high level of security by providing volumetric protection at a competitive performance to cost ratio. The system may be almost impossible to spoof or defeat, unlike fence-based security systems, which can be circumvented by jumping, bridging, or digging. The monitoring system can detect intrusions in three dimensions as well as accurately locate moving and stationary objects. The long-life sensors of the monitoring system can be placed anywhere in the field with little or no geometrical constraints. As an intrusion is detected, a camera may be automatically cued and pointed at the intrusion coordinates for operator alarm and verification.

In some aspects, the monitoring system can be used indoors as well as outdoors. Experiments have confirmed that the monitoring system can detect nightly movements, room entries, including small robotic devices, and items left behind in secured areas. For example, sensors can be placed in a 325 foot radius area around antennas to protect soldiers' camps. As movements take place, the sensors may report the movement to the camp command center. For other applications, the detection range can be extended by increasing the antenna output power above 1 Watt, for example.

Intrusion detection systems according to aspects of the subject technology can be used in data transmission and communications, information fusion, systems integration, perimeter monitoring, and security.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A method for detecting one or more changes in a monitored environment, the method comprising:

transmitting a plurality of interrogation signals to one or more sensors distributed in a monitored environment at a substantially constant power, wherein a first set of the plurality of interrogation signals is transmitted to a first sensor of the one or more sensors;

receiving one or more first response signals from the first sensor in response to the first set of the plurality of interrogation signals transmitted to the first sensor;

determining an average parameter of the one or more first response signals from the first sensor;

comparing the average parameter of the one or more first response signals to an average parameter of a plurality of baseline signals corresponding to the first sensor;

determining a statistical significance of the average parameter of the one or more first response signals based on the comparison; and generating a change detection indicator based on the statistical significance.

2. The method of claim 1, wherein the statistical significance is given by:

$$\frac{X-\mu}{\sigma},$$

where

X is the average parameter of the one or more first response signals,

μ is the average parameter of the plurality of baseline signals corresponding to the first sensor, and σ is the standard deviation from μ.

3. The method of claim 1, wherein the change detection indicator is generated when the statistical significance is a first value, wherein the change detection indicator is not generated when the statistical significance is a second value, and wherein the first value is greater in magnitude than the second value.

4. The method of claim 1, wherein the average parameter of the one or more first response signals represents at least one of an average strength, power, noise level, count, frequency band, frequency, geometry, and range of the one or more first response signals, and wherein the average parameter of the plurality of baseline signals corresponding to the first sensor represents at least one of an average strength, power, noise level, count, frequency band, frequency, geometry, and range of the plurality of baseline signals corresponding to the first sensor.

5. The method of claim 1, wherein none of the one or more sensors communicates with another of the one or more sensors.

6. The method of claim 1, wherein the average parameter of the plurality of baseline signals corresponding to the first sensor is determined by:

transmitting a plurality of test signals to the first sensor in a test environment;

receiving a baseline signal from the first sensor in response to each test signal of the plurality of test signals transmitted to the first sensor for forming the plurality of baseline signals corresponding to the first sensor;

determining a parameter of each baseline signal of the plurality baseline signals corresponding to the first sensor; and determining the average parameter of the plurality of baseline signals corresponding to the first sensor.

7. The method of claim 1, wherein the first set of the plurality of interrogation signals is transmitted to the first sensor of the one or more sensors at a first set of one or more frequencies, wherein a second set of the plurality of interrogation signals is transmitted to a second sensor of the one or more sensors at a second set of one or more frequencies, and wherein the first set of one or more frequencies is different from the second set of one or more frequencies.

8. The method of claim 1, wherein a second set of the plurality of interrogation signals is transmitted to a second sensor of the one or more sensors, wherein the method further comprises receiving one or more second response signals from the second sensor in response to the second set of the plurality of interrogation signals transmitted to the second sensor, wherein the first set of the plurality of interrogation signals and the second set of the plurality of interrogation signals are transmitted in a sequence such that collision between the one or more first response signals and the one or more second response signals is avoided.

9. The method of claim 1, wherein a second set of the plurality of interrogation signals is transmitted to a second sensor of the one or more sensors, wherein the method further comprises:

receiving one or more second response signals from the second sensor in response to the second set of the plurality of interrogation signals transmitted to the second sensor;

determining an average parameter of the one or more second response signals from the second sensor;

comparing the average parameter of the one or more second response signals to an average parameter of a plurality of baseline signals corresponding to the second sensor; and determining a statistical significance of the average parameter of the one or more second response signals based on the comparing the average parameter of the one or more second response signals, wherein the change detection indicator is based on the statistical significance of the average parameter of the one or more first response signals and on the statistical significance of the average parameter of the one or more second response signals.

10. A system for detecting one or more changes in a monitored environment, the system comprising:

an interrogator configured to transmit a plurality of interrogation signals to one or more sensors distributed in a monitored environment at a substantially constant power, to transmit a first set of the plurality of interrogation signals to a first sensor of the one or more sensors, and to receive one or more first response signals from the first sensor in response to the first set of the plurality of interrogation signals transmitted to the first sensor; and a controller coupled to the interrogator, the controller configured to determine an average parameter of the one or more first response signals from the first sensor, to compare the average parameter of the one or more first response signals to an average parameter of a plurality of baseline signals corresponding to the first sensor, to determine a statistical significance of the average parameter of the one or more first response signals based on the comparison, and to generate a change detection indicator based on the statistical significance.

11. The system of claim 10, wherein the statistical significance is given by:

$$\frac{X-\mu}{\sigma},$$

where

X is the average parameter of the one or more first response signals,

μ is the average parameter of the plurality of baseline signals corresponding to the first sensor, and σ is the standard deviation from μ.

12. The system of claim 10, wherein the change detection indicator is generated when the statistical significance is a first value, wherein the change detection indicator is not generated when the statistical significance is a second value, and wherein the first value is greater in magnitude than the second value.

13. The system of claim 10, wherein the average parameter of the one or more first response signals represents at least one of an average strength, power, noise level, count, frequency band, frequency, geometry, and range of the one or more first response signals, and wherein the average parameter of the plurality of baseline signals corresponding to the first sensor represents at least one of an average strength, power, noise level, count, frequency band, frequency, geometry, and range of the plurality of baseline signals corresponding to the first sensor.

14. The system of claim 10, further comprising the one or more sensors, wherein the one or more sensors is configured such that none of the one or more sensors communicates with another of the one or more sensors.

15. The system of claim 10, wherein the interrogator is configured to transmit a plurality of test signals to the first sensor in a test environment, and to receive a baseline signal from the first sensor in response to each test signal of the plurality of test signals transmitted to the first sensor for forming the plurality of baseline signals corresponding to the first sensor, and wherein the controller is configured to determine a parameter of each baseline signal of the plurality of baseline signals corresponding to the first sensor, and to determine the average parameter of the plurality of baseline signals corresponding to the first sensor.

16. The system of claim 10, wherein the interrogator is configured to transmit the first set of the plurality of interrogation signals to the first sensor of the one or more sensors at a first set of one or more frequencies, wherein the interrogator is further configured to transmit a second set of the plurality of interrogation signals to a second sensor of the one or more sensors at a second set of one or more frequencies, and wherein the first set of one or more frequencies is different from the second set of one or more frequencies.

17. The system of claim 10, wherein the interrogator is further configured to transmit a second set of the plurality of interrogation signals to a second sensor of the one or more sensors, wherein the interrogator is configured to receive one or more second response signals from the second sensor in response to the second set of the plurality of interrogation signals transmitted to the second sensor, wherein the interrogator is configured to transmit the first set of the plurality of interrogation signals and the second set of the plurality of interrogation signals in a sequence such that collision between the one or more first response signals and the one or more second response signals is avoided.

18. The system of claim 10, further comprising the one or more sensors, wherein the first sensor is configured to transmit the one or more first response signals to the interrogator based on one or more frequencies of the first set of the plurality of interrogation signals transmitted to the first sensor.

19. The system of claim 18, wherein the first sensor is configured to transmit the one or more first response signals to the interrogator if the one or more frequencies of the first set of the plurality of interrogation signals transmitted to the first sensor is within a predetermined frequency range, and wherein the first sensor is configured to withhold transmission of the one or more first response signals to the interrogator if the one or more frequencies of the first set of the plurality of interrogation signals transmitted to the first sensor is beyond the predetermined frequency range.

20. A machine-readable medium encoded with executable instructions for detecting one or more changes in a monitored environment, the instructions comprising code for:

transmitting a plurality of interrogation signals to one or more sensors distributed in a monitored environment at a substantially constant power, wherein a first set of the plurality of interrogation signals is transmitted to a first sensor of the one or more sensors;

receiving one or more first response signals from the first sensor in response to the first set of the plurality of interrogation signals transmitted to the first sensor;

determining an average parameter of the one or more first response signals from the first sensor;

comparing the average parameter of the one or more first response signals to an average parameter of a plurality of baseline signals corresponding to the first sensor;

determining a statistical significance of the average parameter of the one or more first response signals based on the comparison; and generating a change detection indicator based on the statistical significance.

* * * * *